United States Patent [19]

Algier

[11] 4,036,150

[45] July 19, 1977

[54] DINING TABLE SERVICE ASSEMBLY

[76] Inventor: Joseph C. Algier, 3437 Procyon Ave., Las Vegas, Nev. 89114

[21] Appl. No.: 695,476

[22] Filed: June 14, 1976

[51] Int. Cl.[2] ..... A47B 35/00

[52] U.S. Cl. ..... 108/50; 108/65; 108/114; 297/158

[58] Field of Search ..... 108/114, 48, 65, 69, 108/50, 90; 297/158

[56] References Cited

U.S. PATENT DOCUMENTS

| | | | |
|---|---|---|---|
| 1,452,696 | 4/1923 | Mock | 108/69 |
| 1,967,979 | 7/1934 | Stern | 108/69 |
| 2,305,343 | 12/1942 | Gadbois | 108/69 |
| 2,470,343 | 5/1949 | Dinger | 108/65 |

*Primary Examiner*—Roy D. Frazier
*Assistant Examiner*—Darrell Marquette
*Attorney, Agent, or Firm*—Fulwider, Patton, Rieber, Lee & Utecht

[57] ABSTRACT

A dining table service assembly is provided for use in rapidly serving food or dishes to seated patrons, and for quickly clearing soiled dinnerware and leftovers. A segmented table is provided in which one table segment is stationary in the vicinity of seats for dining patrons. The stationary segment has a flat top and a tongue that extends longitudinally between seats and an edge that includes subjacent supporting surfaces. A removable table segment is positionable in engagement with the stationary segment, and is supported by the subjacent supporting surfaces. A mobile serving cart is provided for carrying the removable table segment in horizontal alignment at a level such that the upper surfaces of the removable segment and the stationary segment are coplanar. When patrons are seated at the table only the stationary segment is in place. Food and dishes are positioned on the removable table segment in place settings while the removable segment is on the serving cart. The cart is rolled into position, and the removable segment is engaged with the stationary segment of the table, thus serving the seated patrons. At the conclusion of the meal, the serving cart is again moved to the table, and the removable table segment is withdrawn and carried away on the cart.

10 Claims, 11 Drawing Figures

FIG. 1
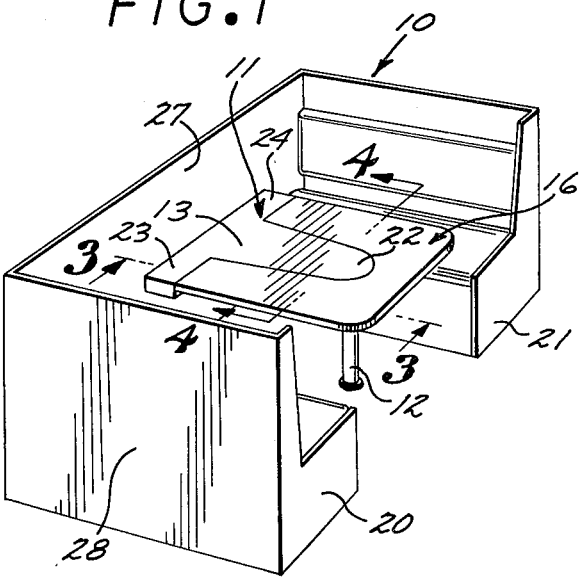
FIG. 2
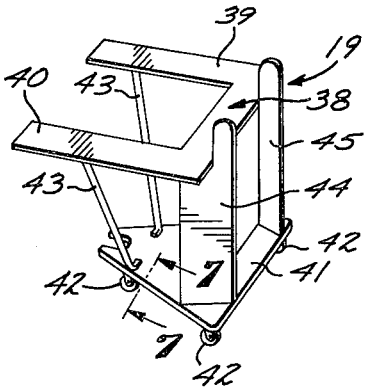
FIG. 3
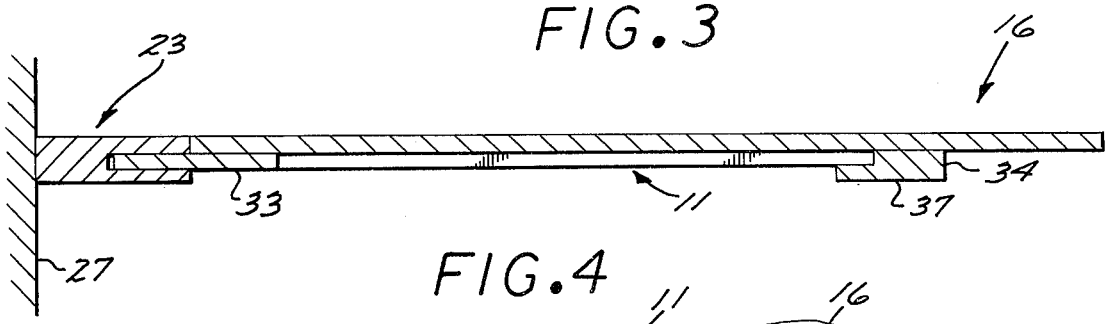
FIG. 4
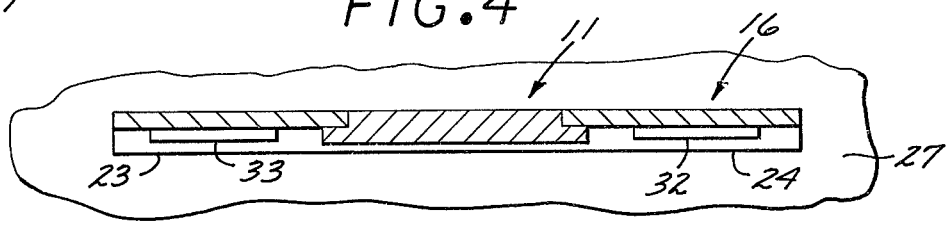
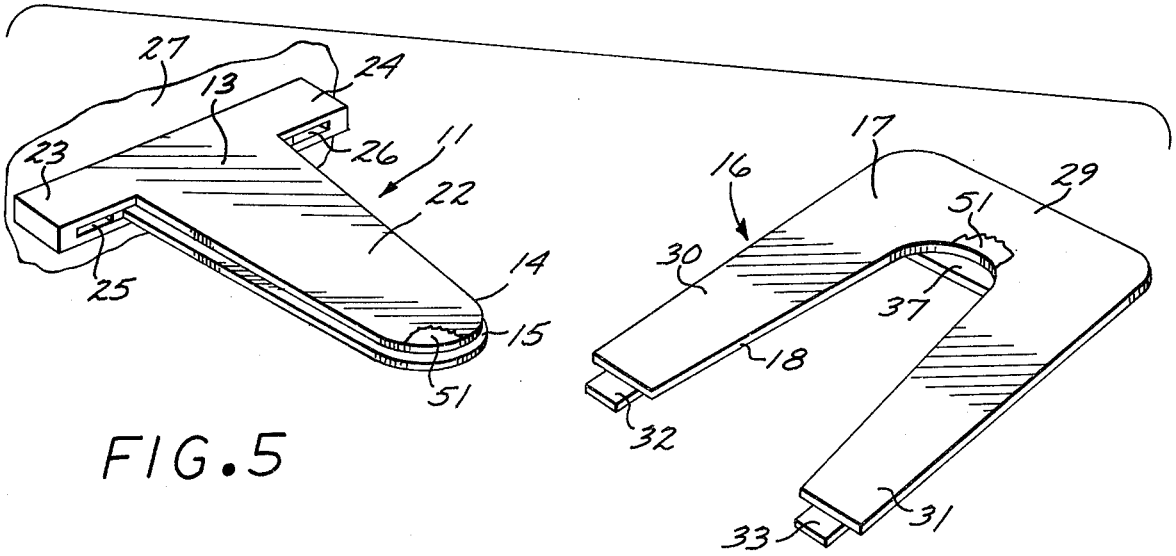
FIG. 5

DINING TABLE SERVICE ASSEMBLY

FIELD OF INVENTION

The present invention relates to a dining table service assembly for bringing food and table settings to seated restaurant patrons in establishments seeking to provide efficiency of service.

BACKGROUND OF THE INVENTION

The manner of serving meals to seated patrons in restaurants has remained substantially unchanged for many years. Traditionally, restaurant patrons are seated at a table or booth, usually facing each other. A waiter or waitress approaches the table with place settings and menus, or the place settings and menus may already be in position at the table. In either even, the waiter or waitress writes down the entree selection of each patron and then turns in the order for the entire table to the chef. The chef prepares the meal and places the meal and service dishes in a location accessible to the waiter or waitress. The service dishes are then manually carried, either on a tray or individually, to the table and placed before the patrons. When the restaurant patrons have finished their meal, the soiled dinnerware and leftovers are manually removed from the table and taken to the kitchen, either individually or on a tray. The table is then cleaned in preparation for subsequent patrons.

In this conventional manner of servicing restaurant tables a considerable amount of manual manipulation and handling of food and dishware at the tables is required on the part of the restarurant personnel. Food and dishes in the kitchen must be moved by the chef to an area accessible to the waiters and waitresses and in turn by them to a tray or directly to the table at which the patrons are seated. In clearing the table, dishes and leftovers must first be cleared from the table and placed in a busman's tray. The tray must then be carried to the kitchen. A dishwasher must lift the various dishes from the tray, dispose of scraps in the garbage, and carry dishware to be reused to a sink for cleaning. The many steps in the manual manipulation of the dishes and the food orders requires the services of many restaurant personnel.

SUMMARY OF THE INVENTION

It is an object of the present invention to reduce the amount of manual manipulation of dishware and meal orders required in a restaurant. This reduction in labor requirement will allow the restaurant staff to concurrently serve a greater number of patrons with greater efficiency than is presently the case.

By reducing the restaurant staff requirement for the service of a particular volume of clientele, the number of restaurant staff members passing among the tables or booths is greatly reduced. This results in the achievement of another object of the invention which is to reduce the congestion and confusion that prevails among members of the restaurant staff in passing through areas crowded with restaurant staff members.

Another object of the invention is to alleviate the irritation of customers whose orders are needlessly delayed. Such delay frequently occurs when waiters or waitresses erroneously pick up orders for delivery to patrons when the orders where originally prepared for different restaurant patrons. In these instances, the patrons for whom the orders were intended are required to wait an inordinately long time for their selected entree to again be prepared.

A related object of the invention is to alleviate the confusion and embarrassment that occurs when orders for a particular table are incorrectly distributed among the patrons seated at that table. The customers in this situation are confused at receiving meals which they did not order, and the waiter or waitress is embarrased at having incorrectly recalled the orders placed by each person.

A further object of the invention is to reduce the amount of food and drink spilled on the floor in the customer serving area. With the present practice of extensive manual manipulation and handling of service plates and food orders, mishaps frequently occur and food is spilled either on customers or on the floor of the restaurant premises. Such mishaps are highly undesirable as they are quite irritating and frustrating to restaurant patrons, and result in excessive food spillage on the restaurant serving floor. This is a both unclean and hazardous to the restaurant patrons and personnel who walk rapidly through the dining area, as they must do in order to provide good service.

The achievement of these and other objects are accomplished by utilizing the apparatus of the present invention.

DESCRIPTION OF THE DRAWINGS

The present invention may be described with greater particularity and clarity by reference to the accompanying drawings in which:

FIG. 1 is a perspective view of a booth employing the dining table service assembly of the invention;

FIG. 2 is a perspective view of a mobile service cart;

FIG. 3 is a sectional elevational view taken along the lines 3—3 of FIG. 1;

FIG. 4 is a sectional elevational view taken along the lines 4—4 of FIG. 1;

FIG. 5 illustrates in perspective the stationary and removable dining table segments of the invention;

DETAILED DESCRIPTION OF THE INVENTION

Figure 6:
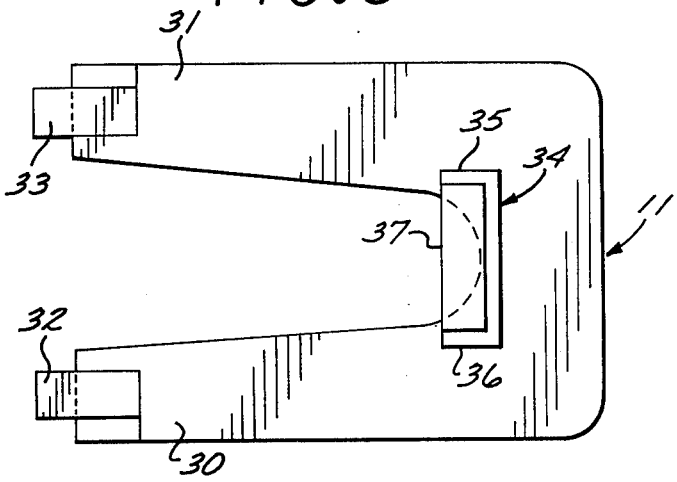
FIG. 6 is a plan view of the underside of the removable table segment.

According to the invention the dining table service assembly 10 is provided with a stationary table segment 11 supported on a upright pedestal 12 and having a horizontal surface 13 terminating at a perimeter, a portion of which forms a curved convex boundary 14 having a subjacent support ledge 15 extending outward therefrom. A removable table segment 16 is also provided and has a flat horizontal upper surface 17. The perimeter of which terminates in a concave boundary 18 designed to fit with the convex boundary 14 in mating fashion. Vertical support for the removable table segment 16 is provided by the support ledge 15 of the stationary segment 11. A mobile serving cart 19 is used to carry the removable table segment 16 in horizontal alignment at the level of the stationary table segment 11.

The stationary dining table segment 11 is secured in place between seating positions with a tongue 22 extending longitudinally between the bench seats 20 and 21. As previously indicated, the laterally expansive horizontal top 13 terminates in a contoured edge 14 while the ledges 15 form subjacent surfaces to support a weight from above. The stationary segment 11 extends laterally outward in a pair of wings 23 and 24 an one longitudinal extremity of the tongue 22. Longitudinally extending recesses 25 and 26 are defined in the stationary segment 11 at the wings 23 and 24 respectively on either side of the tongue 22 below the upper surface of the table top 13.

A vertically aligned laterally extending panel 27 is provided in a manner such that the wings 23 and 24 of the stationary segment 11 are secured to it. The longitudinally aligned bench seats 20 and 21 have backs 28 and 50 respectively associated therewith. The backs 28 and 50, along with the seats 20 and 21 extend from the panel 27 on either side of the stationary table segment 11. The vertical pedestal 12 supports the stationary table segment 11 at the tongue 22 remote from the wings 23 and 24.

At one longitudinal extremity of the removable table top segment 16 is an end 29 from which longitudinal arms 30 and 31 extend. The expansive horizontal upper surface 17 formed by the arms 30 and 31 and the end 29 is coplanar with the table top 13 of the stationary table segment 11 when the removable segment 16 is engaged with the stationary segment 11. Longitudinal appendages 32 and 33 extend from each of the arms 30 and 31 of the removable segment 16 below the upper surface 17. These appendages 32 and 33 are receivable in the recesses 26 and 25 respectively when the removable and stationary table segments are positioned together. In addition, a shallow U-shaped bracket 34 is provided on the underside of the removable table segments 16. This bracket 34 has longitudinally extending legs 35 and 36 which lie on either side of one end of the concave recess in the removable table top segment 16. A laterally disposed member 37 is fastened to the bracket 34 to span the underside of the removable segment 11 between the arms 30 and 31.

As can be seen be reference to FIG. 5, the edges 14 and 18 of the stationary and removable segments 11 and 16 respectively are formed in a mating contour and are spaced so that the arms 30 and 31 of the removable segment 16 are laterally engaged with the tongue 22. When the removable segment 16 and stationary segment 11 are positioned, the appendages 32 and 33 extend into the recesses 26 and 25 respectively and the interior peripheries of the arms 30 and 31 rest on and bear down against the ledge 15. In this manner, the removable table top segment 16 is positionable to contact the periphery of the tongue 22 in engagement with the stationary table segment 11 so that the top 13 of the tongue and the upper surfaces 17 of the arms lie in a comon horizontal plane.

Alternatively, the removable table top segment 16 may be positioned to rest on the mobile serving cart 19. The mobile serving cart 19 carries a horizontally disposed table segment support 38 having laterally spaced supporting members 39 and 40. The support members 39 and 40 extend longitudinally beneath the removable table segment 16 so that the member 39 is in vertical alignment with the arm 30 and the member 40 is in vertical alignment with the arm 31 when the removable table segment 16 is carried on the serving cart 19.

The wheeled serving cart 19 also includes a lower platform 41 to which casters 42 are fastened. The axles of the casters 42 rotate in a horizontal plane, while the wheels mounted thereon are able to rotate in vertical planes about their axles. Upright struts 43 carry the table segment support 38 above the lower platform 41. Upright supports 44 and 45 extend above and to the rear of the table segment support 38 which is horizontally disposed and which abuts the upright supports 44 and 45. This arrangement provides a bearing surface which can be used to longitudinally force the removable table segment 16 in a horizontal direction into engagement with the stationary segment 11. That is, when the removable segment 16 rests on the table segment support 38, the end 29 of segment 16 bears against the upright supports 44 and 45 as the segment 16 is forced into engagement with the segment 11.

Figure 7:
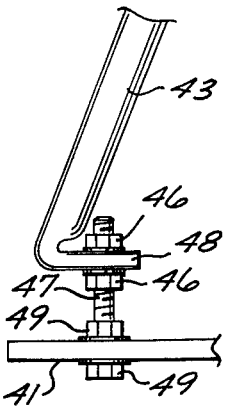
FIG. 7 is an enlarged view of a portion of the mobile serving cart.
Figure 8:
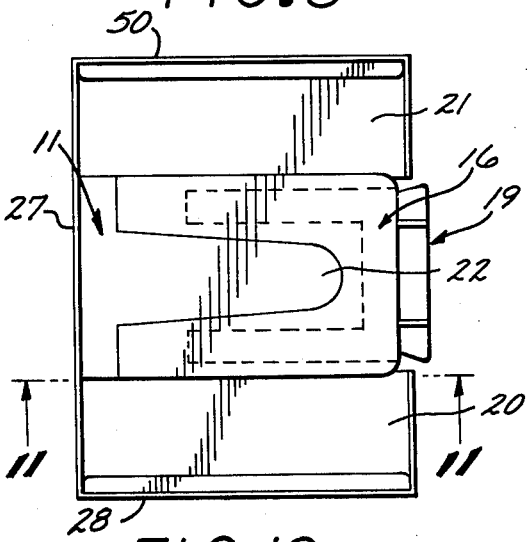
FIG. 8 is a plan view of the booth of FIG. 1 illustrating the manner of interaction of the elements of the invention.
Figure 9:
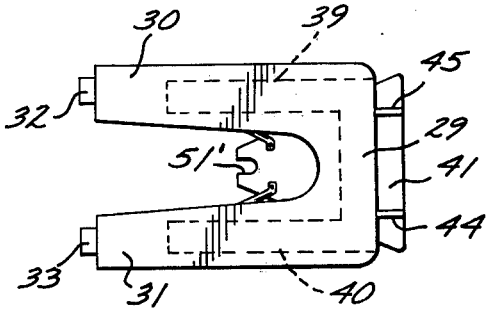
FIG. 9 is a plan view of the mobile serving cart with the removable table segment positioned thereon.
Figure 10:
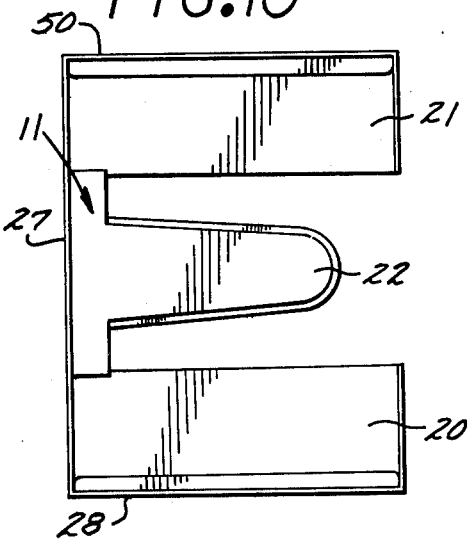
FIG. 10 is a plan view of the booth of FIG. 1 with the removable table segment withdrawn.
Figure 11:
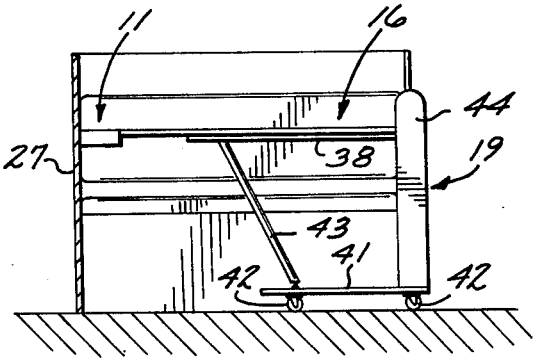
FIG. 11 is an sectional elevational view taken along the lines of 11—11 of FIG. 8.

Upright struts 43 carry the table segment support above the lower platform 41. The upright struts 43 each include height adjustment mechanisms connected thereto between the lower platform 41 and the table segment support 38. Such a height adjustment mechanism is illustrated in FIG. 7. The provision of such an adjustment arrangement allows minor adjustments in height to be made so that the removable support 16 may always be maintained in horizontal alignment with the stationary support 11 as indicated in FIG. 11. The adjustment mechanisms include an upper pair of tightening nuts 46 which are engaged on a threaded bolt 47 on either side of a lower extremity 48 of each strut 43. The lower extremity 48 extends laterally from a crimp at the bottom of the strut 43, and is generally horizontally aligned. A second nut is engaged on the bolt 47 and acts with the head of bolt 47 to secure the bolt 47 to the lower platform 41. Thus, to adjust the height of the table segment 38, one of the nuts 46 need merely be backed off from the end 48 of the strut 43. The strut 43 may then be moved upward or downward as desired, and the other nut tightened to meet it. If upward adjustment is desired, the upper nut 46 is loosened, while if downward adjustment is desired the lower nut 46 is first loosened.

It may be advisable for the serving cart 19 to include a guide mechanism for coacting with the pedestal 12 that supports the tongue 22 of the stationary segment 11. This is useful is bringing the removable table segment 16 into juxtaposition relative to the stationary table segment 11. Such a guide mechanism is formed by a longitudinal guideway 50 in the lower platform 41. Thus, the wheeled surface cart 19 may be directed into positon for the guideway 51' to receive the pedestal 12 to guide the removable table segment 16 into engagement with the stationary table segment 11.

In the utilization of the present invention, restaurant patrons are first conducted to the bench seats 20 and 21 where they may easily be seated since the removable table segment 16 is not in position at that time. This facilitates seating of the patrons, since the only lateral obstruction to them in sitting down on the bench seats 20 and 21 is the width of the tongue 22, which is well out of their way. This feature of the invention allows the booth 10 to be of narrower width than conventional booths and thus allows more booths to be positioned within a given floor area. This increased utilization of available floor space does not result in discomfort to the patrons because of the ease of being seated without the removable segment 16 in position. The spacing of the seats 20 and 21 is limited only by the necessary knee room for the customers.

Once the patrons have been seated, the waitress or waiter attends them and takes their order. Returning to the kitchen, The waitress turns in the meal order to the chef who prepares the food and places the serving dishes in position on the arms 30 and 31 of the removable table segment 16. The order of placement is indicated on the order turned in by the waitress, so that there is no mistake in the positioning of the appropriate entrees on the arms30 and 31.

At this time, the removable segment 16 is located in or adjacent to the kitchen. It may be positioned either on a serving cart 19, or if serving carts are not provided on a one to one ratio with respect to the number of booths 10, the table segment 16 may be otherwise supported at a convenient height. In either event, once the dishes have been placed on the arms 30 and 31 of the table segment 16, the table segment 16 is positioned on a serving cart 19 with the end 29 adjacent to the upright surfaces 44 and 45. The serving cart 19 is then pushed to the appropriate table. The tables, may be numbered or color coded, or include other indicia such as the design 51 which is emblazoned partially on the removable segment 16 and partially on the stationary segment 11. Any portion of the booth 10 and the removable segments 16 may be used for identifying marks so that the proper one of the removable segments 16 is brought to the appropriate booth 10 and engaged with the particular stationary segment 11 located therein. When brought to the booth 10, the cart 19 is pushed toward the vertical panel 27, thus forcing the appendages 32 and 33 into the recesses 26 and 25 and also capturing the end of the tongue 16 by the laterally disposed member 37. The cart 19 is then withdrawn leaving the removable segment 16 supported by the ledge 15 of the stationary segment 11. The pedestal 12 aids in bearing the load.

The patrons then proceed to dine. Once finished, a waiter, waitress, or busboy approaches the table with a cart 19. Again the cart 19 is moved toward the vertical panel 27 so that the longitudinal recess 51' engages the pedestal 12 to appropriately position the cart 19 relative to the removable segment 16. The attending restaurant staff member then grabs the outer edges of the arms 30 and 31 and pulls backward on them thereby drawing the removable segment 16 and the cart 19 away from the vertical panel 27, after first making sure that no dishware lies directly above the contoured edges 14 and 18. The removable segment 16 is then pushed on the cart to the kitchen where all soiled dinnerware and leftovers are removed. The segment 16 is cleaned in the kitchen, thereby avoiding food scraps, crumbs and debris from being unnecessarily spilled in the dining area. The removable segment 16 is then washed and is available for further use.

From the foregoing description of the embodiment of the invention illustrated, it is apparent that various other modifications of the invention may be employed. For example, the utility of the invention is not limited to tables use only in association with booths. To the contrary, a free standing stationary segment 11 supported by a pedestal 12 might be employed in the center of a room. A removable segment 16 could be engaged with such a stationary segment 11 in the same manner as has been described herein. Undoubtedly, other modifications nd variations of the invention will become readily apparent to those familiar with the operation and management of dining establishments and with the provisions of articles of manufacture for use in such establishments.

I claim:

1. A dining table service assembly for providing food to seated patrons comprising:

a. a stationary dining table segment secured in place between seating positions and having a tongue extending longitudinally between said seating positions with a laterally expansive horizontal top terminating in contoured edges with subjacent surfaces for supporting a weight from above, b. a mobile serving cart carrying a table segment support having laterally spaced supporting members, c. a separate removable dining table segment having longitudinally extending arms with expansive horizontal upper surfaces terminating in edges formed in a contour to mate with the aforesaid contour of said edges of said tongue and spaced for lateral engagement with the aforesaid tongue to rest on and bear down against said subjacent surfaces, said removable table segment being positionable to removably engage said stationary table segment with the top of said tongue and the upper surfaces of said arms, lying in a common horizontal plane, and also being positionable to be removably supported on said table segment support separate from said stationary dining table segment.

2. The dining table service assembly of claim 1 wherein said stationary segment extends laterally outward in a pair of wings at one longitudinal extremity of said tongue to define longitudinally extending recesses in said stationary segment on either side of said tongue below the upper surface of said laterally expansive table top, and longitudinal appendages extend from each of the aforesaid arms of said removable table segment below said upper surfaces, and are receivable in said recesses.

3. The dining table service assembly of claim 2 further comprising a laterally disposed member spanning the underside of said removable segment between said arms.

4. The dining table service assembly of claim 2 further comprising a vertically aligned laterally extending panel to which said wings of said stationary segment are secured, and longitudinally aligned bench seats extend from said panel on either side of said stationary table segment, and a vertical pedestal supports said tongue of said stationary table segment remote from said wings.

5. The dining table service assembly of claim 1 wherein said mobile serving cart is mounted on casters and includes upright support means extending above and to the rear of said table segment support which is horizontally disposed and which abuts said upright support means, thereby providing a bearing surface which can be used to longitudinally force said removable table segment in a horizontal direction into engagement with said stationary segment.

6. The dining table service assembly of claim 5 wherein said mobile serving cart additionally includes a lower platform to which casters are fastened, and upright struts carry said table segment support above said lower platform, and said upright struts include height adjustment mechanisms connected thereto between said lower platform and said table segment support.

7. The dining table service assembly of claim 6 further characterized in that a pedestal supports said tongue and a longitudinal guideway is defined in said lower platform, whereby said wheeled serving cart may be directed into position for said guideway to receive said pedestal to guide said removable table segment into engagement with said stationary table segment.

8. A dining table service assembly comprising:

a stationary table segment supported on an upright pedestal and having a horizontal surface terminating at a perimeter at least a portion of which forms a curved convex boundary having a subjacent support ledge extending outward therefrom;

a separate removable table segment having a flat horizontal upper surface the perimeter of which terminates in a concave boundary designed to removably fit with said convex boundary in mating fashion with vertical support for said removable table segment provided by said support ledge of said stationary table segment; and a mobile serving cart for separately carrying said removable table segment in horizontal alignment at the level of said stationary table segment.

9. The dining table service assembly of claim 8 in which said serving cart includes laterally spaced support members extending longitudinally beneath said removable table segment in vertical alignment therewith when said removable table segment is carried on said serving cart.

10. The dining table service assembly of claim 8 in which said serving cart includes a guide mechanism for coacting with said pedestal to bring said removable table segment into juxtaposition relative to said stationary table segment.

* * * * *

UNITED STATES PATENT OFFICE

CERTIFICATE OF CORRECTION

Patent No. 4,036,150 Dated July 19, 1977

Inventor(s) Joseph C. Argier

It is certified that error appears in the above-identified patent and that said Letters Patent are hereby corrected as shown below:

Column 1, line 17, after "In either" delete "even" and substitute therefor -- event --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,036,150 Dated July 19, 1977

Inventor(s) Joseph C. Argier

It is certified that error appears in the above-identified patent and that said Letters Patent are hereby corrected as shown below:

Front page, inventor's name is misspelled in both places it appears and should be changed to read --Argier--.

Column 1, line 17, after "In either" should read --event--.

Column 2, line 20, after "This is" delete "a"; line 52, after "Fig. 11" should read --a--.

This certificate is to supersede certificate which issued December 13, 1977.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*